US005950909A

United States Patent [19]

Peterson et al.

[11] Patent Number: 5,950,909

[45] Date of Patent: Sep. 14, 1999

[54] PRESSURE SENSITIVE COHESIVE PATTERNS FOR Z FOLD AND C FOLD BUSINESS FORMS

[75] Inventors: Wayne Charles Peterson, Hooksett; Theodore Michael Chappell, Manchester, both of N.H.

[73] Assignee: Moore U.S.A., Inc., Grand Island, N.Y.

[21] Appl. No.: 09/005,824

[22] Filed: Jan. 12, 1998

[51] Int. Cl.[6] ..... B65D 27/10; B65D 27/16

[52] U.S. Cl. ..... 229/92.1; 206/390

[58] Field of Search ..... 229/92.1, 92.8; 206/390

[56] References Cited

U.S. PATENT DOCUMENTS

| | | | |
|---|---|---|---|
| 2,000,763 | 5/1935 | Lane . | |
| 3,916,051 | 10/1975 | Wakeman . | |
| 4,320,868 | 3/1982 | Petersson . | |
| 4,768,810 | 9/1988 | Mertens . | |
| 4,918,128 | 4/1990 | Sakai . | |
| 5,174,493 | 12/1992 | File | 229/92.1 |
| 5,193,850 | 3/1993 | Lombardo . | |
| 5,201,464 | 4/1993 | File . | |
| 5,253,798 | 10/1993 | Lombardo . | |
| 5,294,041 | 3/1994 | Whiteside | 229/92.1 |
| 5,314,110 | 5/1994 | Lombardo | 229/92.1 |
| 5,318,324 | 6/1994 | Lombardo et al. . | |
| 5,334,571 | 8/1994 | Baxter . | |
| 5,360,160 | 11/1994 | Sauerwine et al. . | |
| 5,372,302 | 12/1994 | Loch et al. . | |
| 5,376,048 | 12/1994 | Whiteside | 229/92.1 |
| 5,402,934 | 4/1995 | Sauerwine . | |
| 5,409,752 | 4/1995 | Juteau . | |
| 5,427,851 | 6/1995 | Mehta . | |

*Primary Examiner*—Stephen P. Garbe
*Attorney, Agent, or Firm*—Nixon and Vanderhye

[57] ABSTRACT

In the production of mailer type business forms, particularly from a web in a roll configuration having a plurality of business form intermediates, with pressure sensitive cohesive, the problem of cohesive blocking (sticking together) at inopportune times is avoided by spacing substantially linear patterns of the cohesive disposed in the detachable side edges of the intermediates so that when the intermediates are in the roll configuration the cohesive from one intermediate does not engage the cohesive from another. Preferably the cohesive patterns on one face of the intermediate are spaced from the parallel cohesive patterns on the second face of the intermediate by about 1–15 mm, preferably about one centimeter. Transversely extending patterns of cohesive also may be positioned so that they too do not engage in the roll configuration, even though engagement of the transverse patterns is much less of a problem because the potential areas for engagement are few when the intermediates are in the roll configuration.

16 Claims, 6 Drawing Sheets

PRESSURE SENSITIVE COHESIVE PATTERNS FOR Z FOLD AND C FOLD BUSINESS FORMS

BACKGROUND AND SUMMARY OF THE INVENTION

Mailer type business forms utilizing pressure sensitive cohesive, particularly in Z-fold and C-fold (normal or eccentric) configurations, are increasingly more popular. The pressure sensitive cohesive utilized is that used with the SpeediSealer® pressure seal equipment marketed by Moore U.S.A. of Lake Forest, Ill. One particular form of such adhesive that is particularly desirable is that sold by Toppan of Japan under the trade designation TN-124, which is a styrene-natural rubber copolymer and is shown in U.S. Pat. No. 5,427,851 and in U.S. Pat. No. 4,918,128 (the disclosure of which is hereby incorporated by reference herein). Other commercially available pressure sensitive cohesives may be those described in U.S. Pat. No. 5,201,464, the disclosure of which is hereby incorporated by reference herein.

In a typical Z-fold (such as shown in U.S. Pat. Nos. 5,193,850 and 5,253,798) or C-fold (the 5,201,464 patent) mailer type business forms with pressure sensitive cohesive, in high speed manufacturing installations there can be a problem with blocking of the adhesive at the press, or at other points during manufacture, particularly when in a roll configuration. This is caused by pressure sensitive cohesive in the edge strips on one face of the business form intermediates in a roll engaging such cohesive on the second face of underlying intermediates in the same roll. This can result in damaged product, press interruptions, and a wide variety of other adverse consequences, and have heretofore not been corrected.

According to the present invention the problem of blocking as described above is solved by providing the pressure sensitive cohesive patterns and the longitudinal edge strips spaced from each other on the first and second faces of the intermediates so that when the intermediates are in a roll configuration (or otherwise in the position where the first face of one intermediate engaging the second face of another) the cohesive patterns cannot touch each other and therefore there is no potential for a blocking problem. While a blocking problem is not significant presently for strips or other patterns of pressure sensitive cohesive that extend transversely to the edge strips (since they very infrequently come in contact with each other in the roll configuration), according to the invention it is also possible to space the transverse patterns too so that they also cannot come in contact with each other when the intermediates are in a roll configuration.

According to one aspect of the present invention a mailer-type business intermediate is provided comprising the following components: A sheet or web of paper having first and second surfaces, and first and second substantially parallel side edges. First and second lines of weakness formed in the web adjacent and substantially parallel to the first and second side edges, respectively to define first and second edge strips, the edge strips each having a width X, in the dimension transverse to the first and second edges. First and second substantially linear patterns of pressure sensitive cohesive disposed on the first face in the first and second strips, respectively, adjacent the first and second lines of weakness, respectively, and substantially parallel to the first and second lines of weakness, each of the first and second substantially linear patterns having a width Y which is less than X (typically less than one-half of X). Third and fourth substantially linear patterns of pressure sensitive cohesive disposed on the second face in said first and second strips, respectively, adjacent the first and second edges, respectively, and substantially parallel to the first and second edges, each of the third and fourth substantially linear patterns having a width Z which is less than X (typically less than one-half of X), and Y plus Z is less than X, so that the first and second patterns of cohesive do not overlap, respectively, the third and fourth patterns of adhesive, and so that substantially no cohesive in the first and second strips on the first face overlaps cohesive in the strips on the second face in the transverse direction. And, a plurality of fold lines disposed in the web or sheet extending substantially perpendicular to the first and second side edges.

In a preferred embodiment the web or sheet is in roll configuration with the first and second faces of different portions of the web or sheet in contact with each other while the first and second edges of all portions of the web or sheet are in alignment, the first and second patterns of adhesive not engaging, respectively, the third and fourth patterns of adhesive. Typically Y is substantially equal to Z, and the first and second patterns of cohesive are spaced in the transverse dimension from, respectively, the third and fourth patterns of cohesive, a distance D. The distance D may be at least 5 mm, or at least between about 1–15 mm, and is preferably about one centimeter.

A plurality of transverse extending substantially linear patterns of pressure sensitive cohesive may also be provided disposed adjacent and substantially parallel to at least some of the fold lines. If desired, the plurality of transversely extending patterns of cohesive may comprise patterns in both the first and second faces, and the cohesive on the first face may be spaced from the cohesive on the second face in the transverse dimension so that the transversely extending patterns on the first and second faces do not overlap.

Preferably the web comprises a plurality of intermediates and a plurality of the fold lines comprise lines of weakness, separately the plurality of intermediates from each other into individual intermediates, which are made into individual mailer type business forms. The intermediates are preferably Z-fold or eccentric Z-fold intermediates, although the invention is also readily applicable to C-fold or eccentric C-fold intermediates. The invention need not be used on V-fold intermediates since the blocking problem does not occur there.

According to another aspect of the present invention a method of making mailer type business forms from intermediates in a roll configuration as described above is provided. The method comprises the steps of sequentially: (a) Mounting the roll for rotation about a generally horizontal axis for let-off of the intermediates, the linear patterns of pressure sensitive adhesive not overlapping so that blocking is avoided. (b) Feeding the intermediates from the roll to a printer. (c) Printing the intermediates from the roll in seriatim in the printer, including printing outgoing addresses. (d) Detaching individual printed intermediates from the roll. (e) Folding each of the detached intermediates so that the cohesive patterns in the edge strips thereof are in contact with each other. And, (f) applying pressure to each of the folded intermediates sufficient to cause the cohesive patterns to seal, and thereby form a completed mailer.

The intermediates may include tractor drive strips outside of the first and second edges thereof, and there may be the further step of cutting off the tractor drive strips prior to step (f) (typically even before step (a), or after step (c)). Step (e) may be practiced by Z-folding or C-folding the detached intermediates, depending upon the configuration of the intermediates in the roll.

According to yet another aspect of the present invention a Z-folded mailer type business from is provided comprising the following components: At least first, second and third quadrate panels overlapping each other and formed from a single sheet of paper having first and second substantially parallel end edges, and first and second side edges substantially parallel to each other and substantially perpendicular to the end edges. First and second lines of weakness formed in the sheet extending adjacent and spaced from and substantially parallel to the side edges. The panels each comprising top and bottom faces, the top face of the first panel being a continuation of the bottom face of the second panel and the top face of the third panel, and the bottom face of the first panel being a continuation of the top face of the second panel and the bottom face of the third panel. First and second substantially linear patterns of pressure sensitive cohesive disposed on the first panel bottom face and the second panel top face in the edge strips adjacent one of the side edges or the lines of weakness thereof, and mating with each other to hold the first and second panels together. Third and fourth substantially linear patterns of pressure sensitive cohesive disposed on the second panel bottom face and the third panel top face in the edge strips adjacent the other of the side edges or the lines of weakness thereof, and mating with each other to hold the second and third panels together. The third and fourth patterns of cohesive being spaced from the first and second patterns of cohesive a distance of between about one-fifteen mm in a dimension parallel to the end edges, so that the third and fourth patterns of cohesive do not overlap the first and second patterns of cohesive. And, outgoing address indicia formed on one of the panels so that the indicia is visible when the top face of the first panel is viewed. For example the outgoing address indicia is preferably imaged on the top face of the first panel (either directly, or on a label applied thereto), although if a window is provided in the first panel, the outgoing address may be imaged on the top face of the second panel. Similar mailer type business forms may be made by C-folding.

It is the primary object of the present invention to provide for the construction of Z-fold or C-fold mailer type business forms from intermediates in a roll, or like, configuration which substantially avoids the blocking problem. This and other aspects of the invention will become clear from an inspection of the detailed description of the invention and from the appended claims.

DETAILED DESCRIPTION OF THE DRAWINGS

Figure 1:
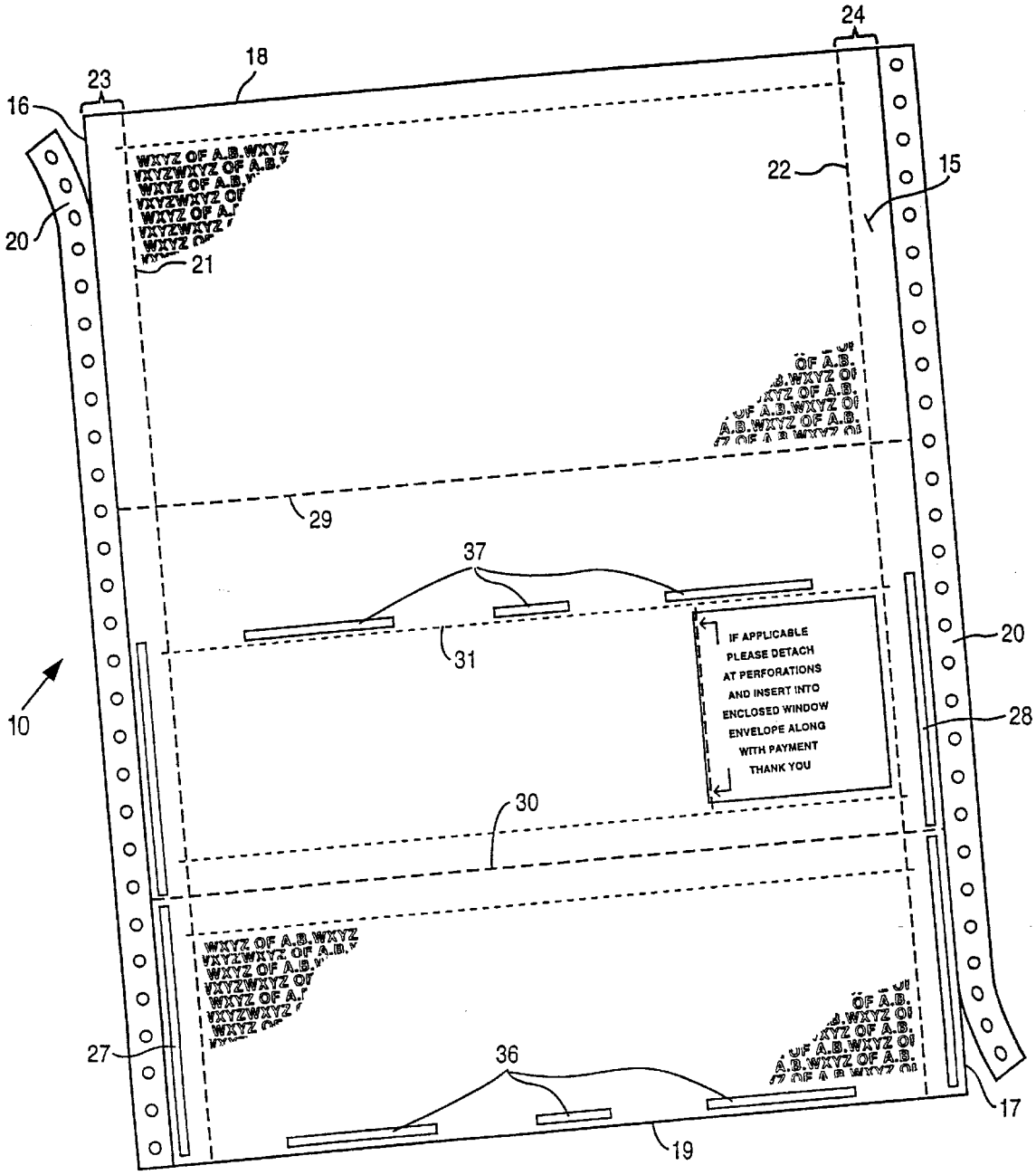
FIG. 1 is a top perspective view of an exemplary intermediate for a mailer type business form according to the present invention.
Figure 3:
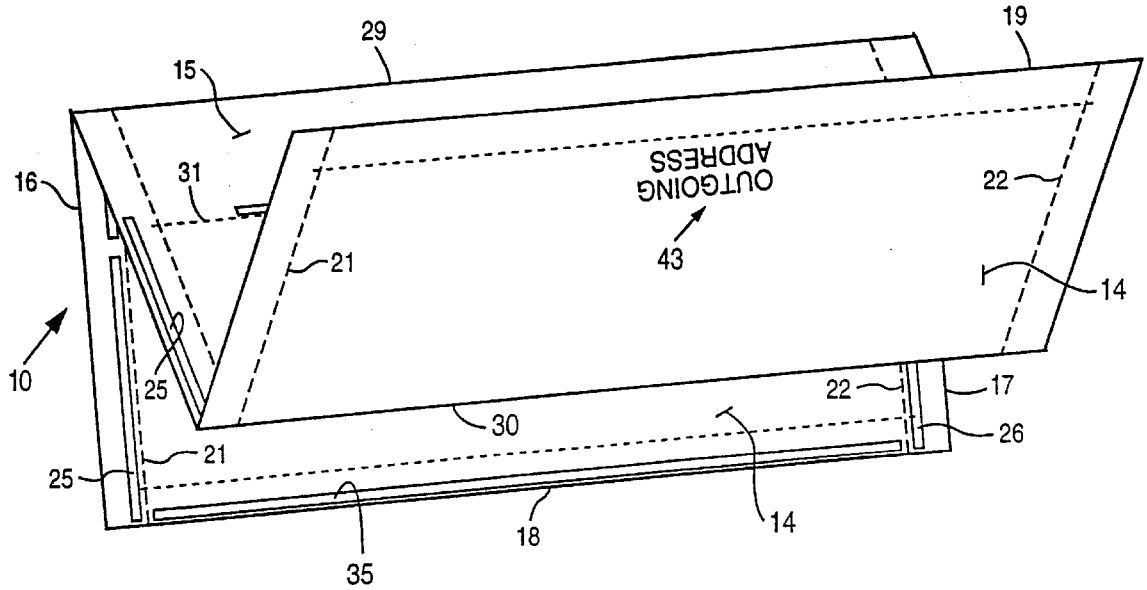
FIG. 3 is a top perspective view showing the intermediate of FIGS. 1 and 2 being eccentrically Z-folded to form a mailer type business form.
Figure 4:
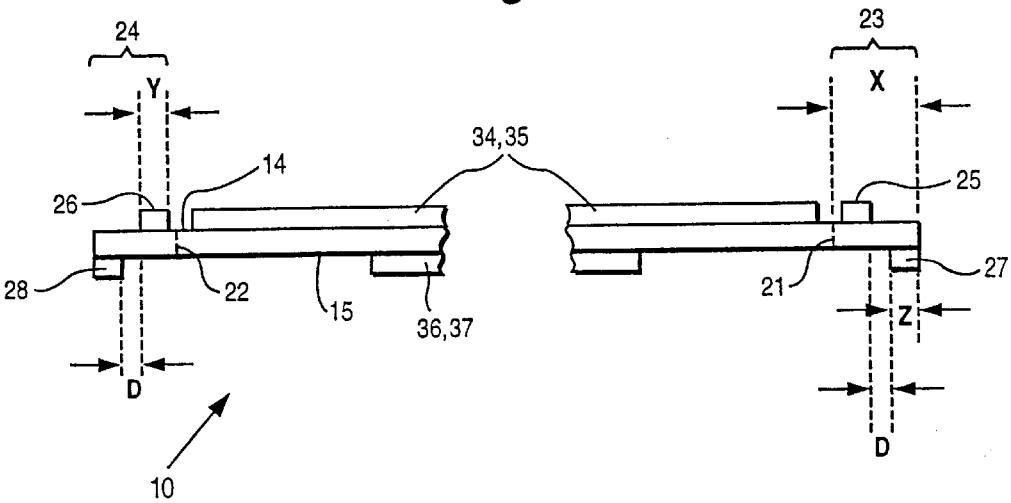
FIG. 4 is an end schematic view of the intermediate of FIGS. 1 and 2 showing the cohesive portions thereof greatly enlarged in size for clarity of illustration, and indicating the relative positioning thereof.
Figure 5:
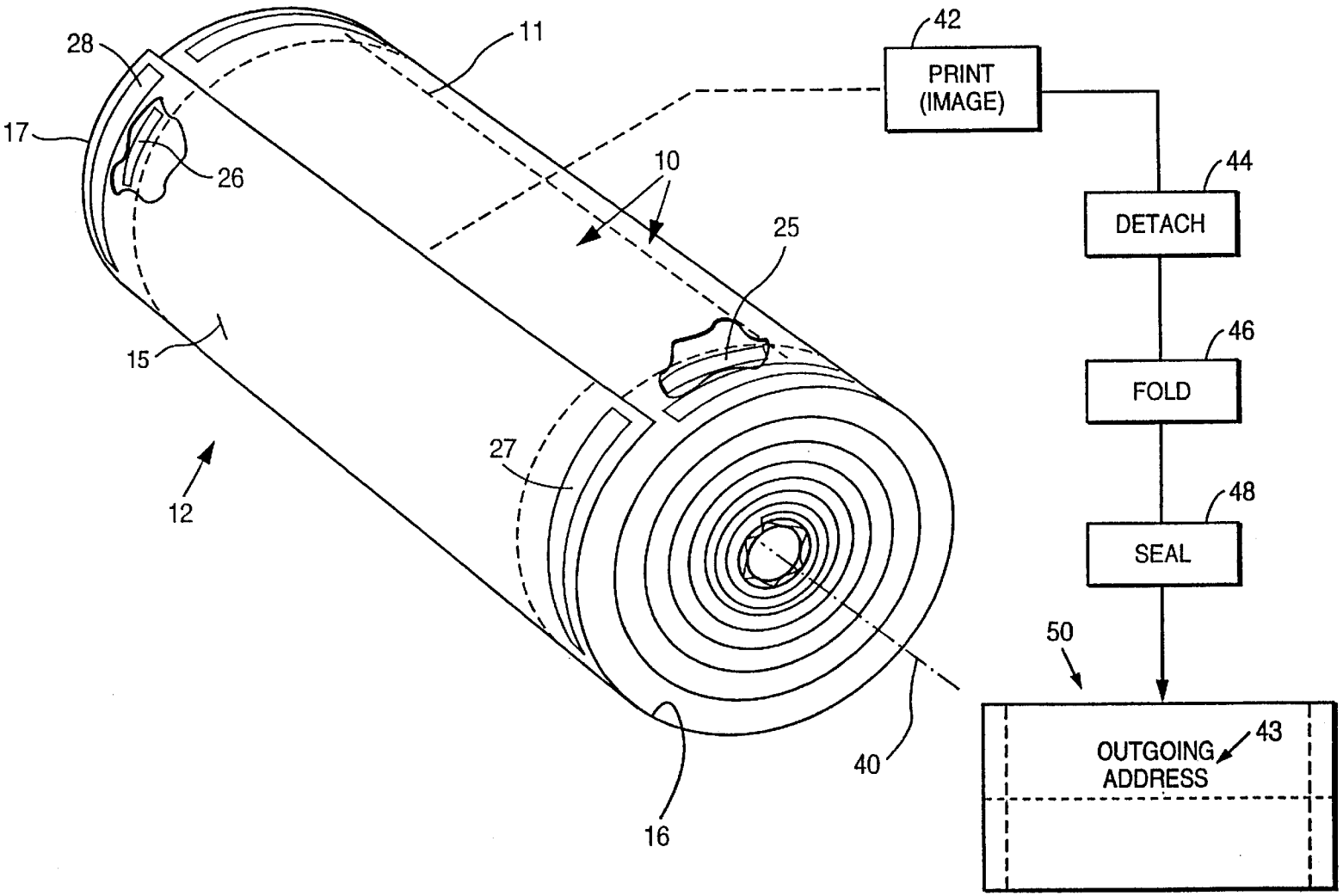
FIG. 5 is a schematic view showing a roll configuration of a plurality of the intermediates of FIGS. 1 through 4 and the method steps utilized to form mailer type business forms from the roll of intermediates.

An intermediate 10 for an exemplary eccentric Z-folded mailer type business form according to the present invention is shown generally by reference numeral 10 in FIGS. 1 through 4, and in a roll configuration with a plurality of other intermediates, separated by transverse lines of weakness 11, by reference numeral 12 in FIG. 5. While the intermediate 10 may be in web or sheet (as illustrated in FIG. 1) form, it preferably is in web form with a plurality of other intermediates 10, again as illustrated generally by the roll configuration 12 of FIG. 5.

Figure 2:
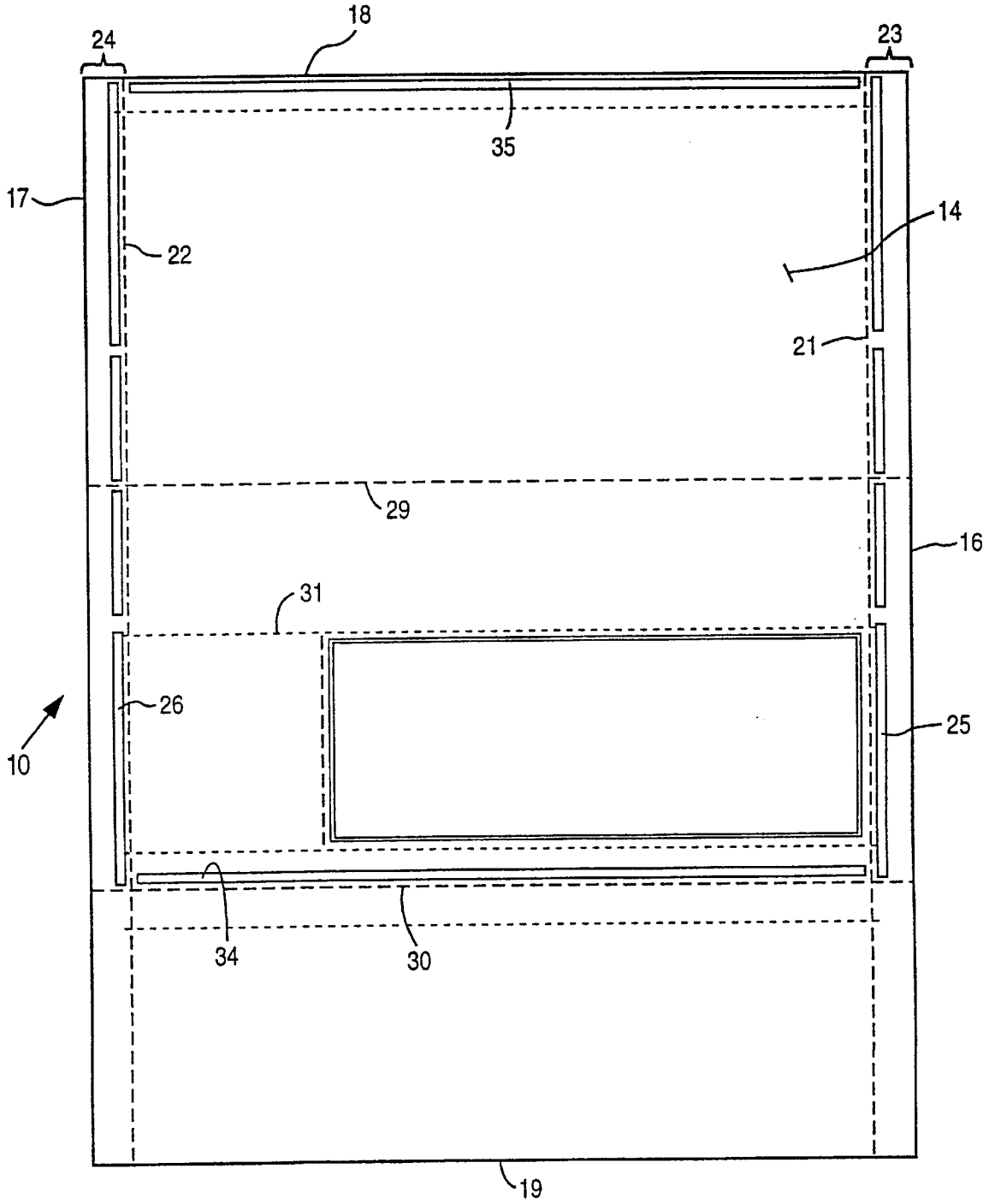
FIG. 2 is a bottom plan view of the intermediate of FIG. 1 but with the tractor drive strips removed.

The intermediate 10 is of paper (when in sheet form a quadrate sheet of paper as illustrated in FIGS. 1 through 3). The paper has a first face 14 (see FIG. 2 in particular) and a second face 15. It also has substantially parallel first and second side edges 16, 17. In sheet form the intermediate 10 also includes first and second end edges 18, 19, the end edges 18, 19 being substantially parallel to each other and substantially perpendicular to the side edges 16, 17.

Normally at some point during the process of the manufacture or utilization of the intermediates 10, or the formation thereof into mailer type business forms, conventional tractor drive strips—seen by reference numeral 20 in FIG. 1—are provided. However the tractor drive strips 20 are cut from the rest of the intermediate 10 (typically by a conventional slitter) at some point during processing, as it is undesirable to provide the tractor drive strips 20 on the final business forms.

The intermediates 10 also include first and second lines of weakness 21, 22 (preferably perforations, although other conventional lines of weakness, such as score lines, die cuts, or the like may be provided). The first and second lines of weakness 21, 22 are adjacent and substantially parallel to the first and second side edges 16, 17, respectively, and define first and second side edge strips 23, 24, respectively. The side edge strips 23, 24 each have a width X (see FIG. 4) in the dimension transverse to the side edges 16, 17 (that is parallel to the end edges 18, 19).

The intermediate 10 also comprises first and second substantially linear patterns (e.g. strips or continuous strips or a series of dots or other geometric shapes) 25, 26 (see FIGS. 2 and 4 in particular) disposed on the first face 14 in the first and second strips 23, 24, respectively, adjacent the first and second lines of weakness 21, 22, respectively. The patterns 25, 26 are substantially parallel to the first and second lines of weakness 21, 22 (and thus to the side edges 16, 17). Each of the patterns 25, 26 has a width Y (see FIG. 4) which is less than X, preferably less than one half of X.

The intermediate 10 also comprises third and fourth substantially linear patterns of pressure sensitive adhesive 27, 28 (see FIGS. 1 and 4 in particular) disposed on the second face 15 in the first and second strips 23, 24, respectively, and substantially parallel to the first and second edges 16, 17. Each of the third and fourth substantially linear patterns 27, 28 has a width Z (seen most clearly in FIG. 4) which is less than X, preferably less than one half of X, and Y plus Z is less than X, so that the first and second patterns of cohesive 25, 26 do not overlap, respectively, the third and fourth patterns of adhesive 27, 28, as clearly seen in FIG. 4. Also, substantially no cohesive in the first and second strips on the first face 14 overlaps cohesive on said second face in said transverse dimension (as also clearly seen in FIG. 4 where only the patterns 25–28 are provided).

The intermediate 10 also includes a plurality of fold lines disposed in the web or sheet extending substantially perpendicular to the side edges 16, 17. In the embodiment illustrated in FIGS. 1 through 3, where an eccentric Z-fold intermediate is provided, those fold lines comprise at least a first fold line 29 which is the closest fold line to the end edge 18, the second fold line 30, which is the closest fold line to the second end edge 19, and an intermediate fold line 31, related to the functionality of the particular intermediate 10 illustrated, may also be provided if desired. The fold lines 29 through 31 may be score lines, crease lines, or—preferable for some circumstances—lines of weakness.

Preferably the width Z is substantially equal to the width Y. The respective strips 25, 27 and 26, 28 are spaced from each other in the transverse dimension a distance D, as illustrated in FIG. 4. The distance D is typically between about 1–15 mm, preferably at least about 5 mm, and most desirably approximately one centimeter. This ensures no possibility that blocking will occur even if there is a minor skewing of the intermediates 10 in the roll configuration 12.

Each intermediate 10 also preferably includes a plurality of transversely extending substantially linear patterns of pressure sensitive cohesive disposed adjacent and substantially parallel to at least some of the fold lines 29–31 or transverse edges 18, 19. For example in the embodiment illustrated in FIGS. 1 through 4 pressure sensitive cohesive strips 34, 35 are disposed adjacent the fold line 30 and the transverse edge 18, respectively, on the face 14, the strips 34, 35 coming into mating contact with each other when the intermediate 10 is folded about the fold line 29. Also in the embodiment illustrated in FIGS. 1 through 4 the cohesive strips 36, 37, adjacent the transverse edge 19 and the fold line 31, respectively, on the face 15 (see FIG. 1 in particular) come into contact with each other when the intermediate 10 is folded about the fold line 30. Normally in a roll configuration there is not a significant problem with the strips 34, 35 coming into contact with the strips 36, 37. However if that possibility is to be completely avoided then the configuration illustrated schematically in FIG. 8 may be provided.

Figure 8:
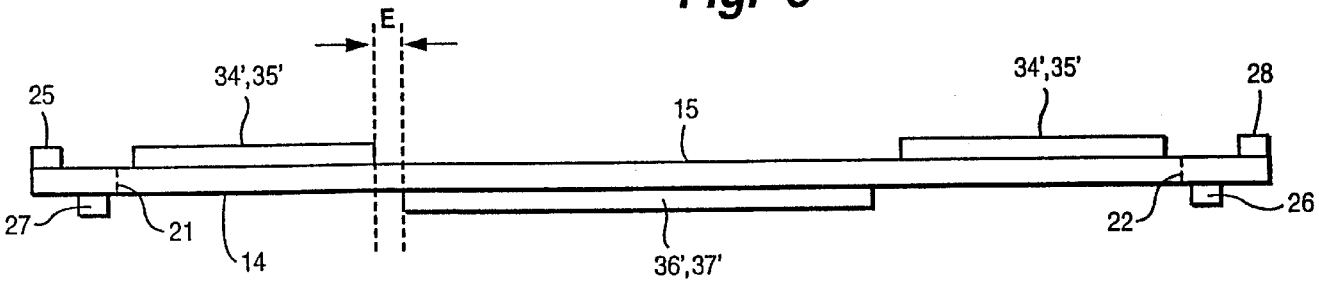
FIG. 8 is a view like that of FIG. 4 only showing an embodiment in which the transversely extending patterns of pressure sensitive cohesive are also spaced from each other so that they do not overlap in the roll configuration of FIG. 5.

In FIG. 8 components that are the same as those in the FIG. 4 embodiment are shown by the same reference numeral, and components almost the same, but slightly different, are shown by the same reference numeral only followed by a "'". In this embodiment the transversely extending strips of pressure sensitive cohesive 34', 35' are spaced in the transverse dimension from the strips 36', 37'—having a spacing E in the transverse dimension (typically about one millimeter or more) so that when in the roll configuration 12 the strips 34, 35' can never inadvertently touch (with a potential problem of blocking) the strips 36', 37'.

FIG. 5 illustrates schematic use of the roll 12 of the intermediates 10 according to the invention. The intermediates 10 are separated from each other in the roll 12 by lines of weakness 11, which ultimately form the edges 18, 19 when the individual intermediates 10 are detached from the web in the roll configuration 12. The cut away portions of the roll 12 indicate here—just as FIG. 4 does—that the strips 25, 27 do not touch from one face to the other, and the strips 26, 28 also do not touch.

In the practice of the method according to the invention, with particular reference to FIG. 5, the roll 12 is mounted for rotation, preferably about a generally horizontal axis 40, for let-off of the intermediates 10. Any conventional let-off or unwind mechanism may be utilized. The intermediates 10 are then fed (using conventional rollers or other drive mechanisms) to a printer 42 (which images indicia on the intermediates 10). The printer 42 may comprise any conventional printer for imaging suitable indicia, including outgoing address indicia 43 (see FIG. 3). After imaging, the web is fed to a conventional detacher 44 where the intermediates 10 are detached along the lines of weakness 11 from each other. The intermediates 10 are then passed to a conventional folder 46 where they are either Z or C folded (depending upon the construction of the intermediates—the intermediate of FIGS. 1 through 4 are Z-folded, and eccentrically Z-folded), such as illustrated schematically in FIG. 3, to bring the cohesive patterns 25–28 and the edge strips 23, 24 into contact with each other. Then using conventional SpeediSealer® equipment 48 from Moore U.S.A. of Lake Forest, Ill., or the like, pressure (typically at least about 100 lbs. per square inch) is applied to the cohesive patterns 25–28 sufficient to cause the cohesive patterns to seal to each other, thereby forming a completed mailer, as indicated schematically at 50 in FIG. 5. The tractor drive strips 20, may be provided initially when in the roll configuration 12 to facilitate passage through at least the printer 42, although the tractor drive strips may be slit off before the roll configuration 12 is formed, and usually certainly will be slit off before the folding operation 46.

Figure 6:
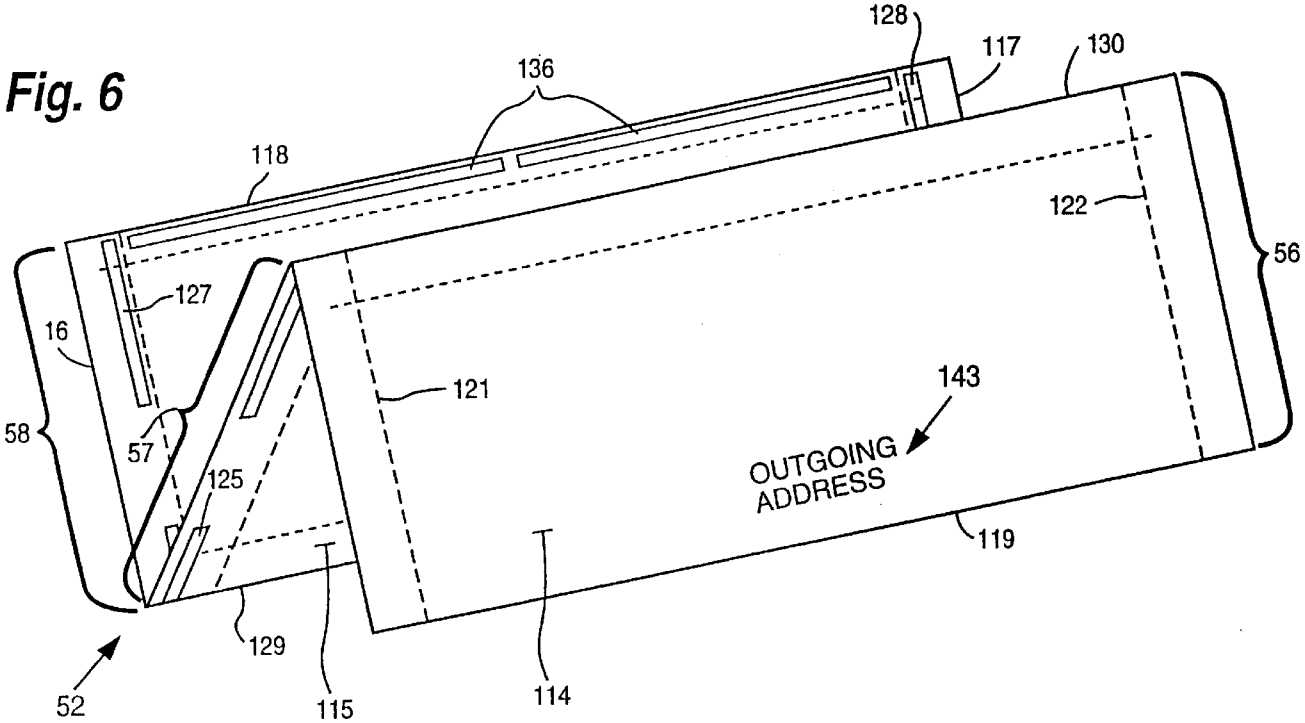
FIG. 6 is a view like that of FIG. 3 only for a non-eccentric Z-folded mailer type business form according to the invention.
Figure 7:
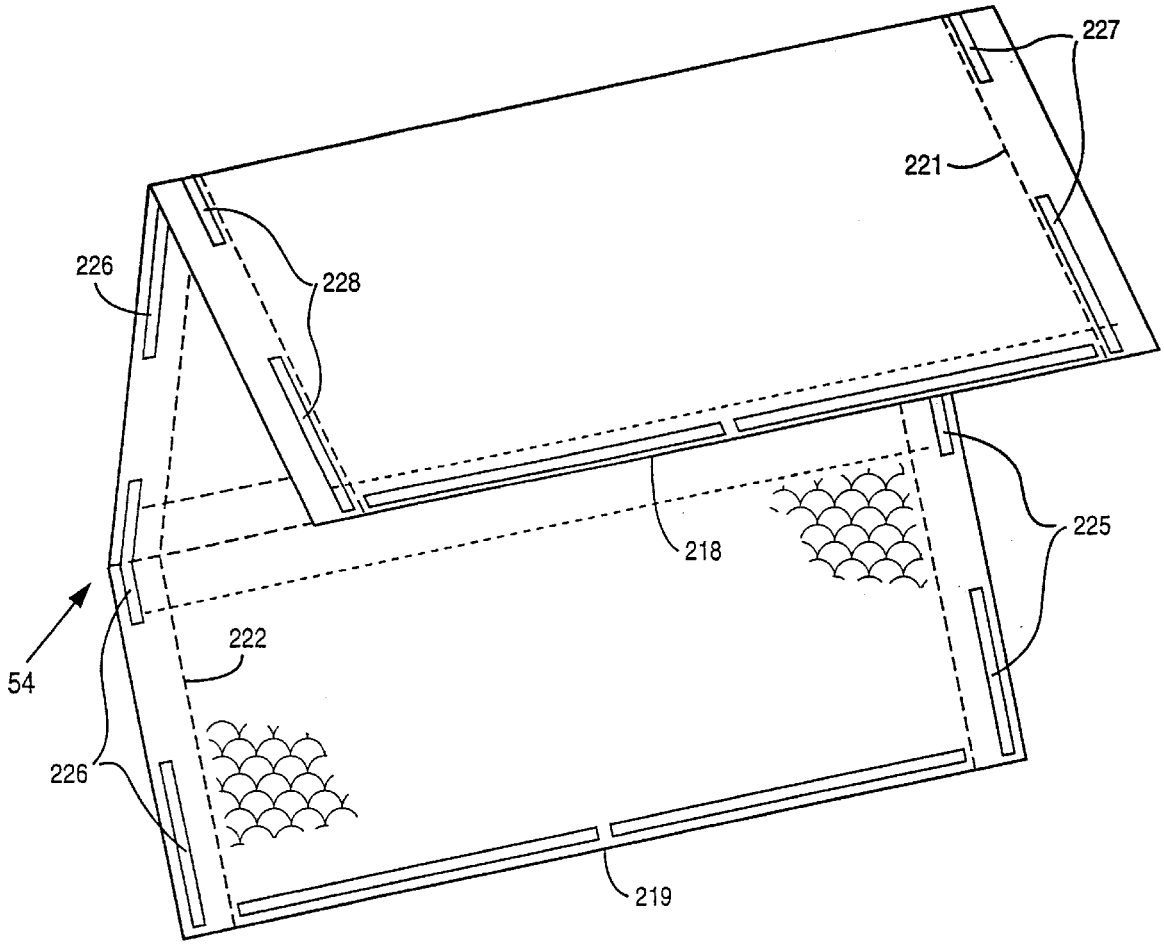
FIG. 7 is a view like that of FIG. 6 only for a C-folded business form according to the invention.

FIGS. 6 and 7 illustrate other configurations of intermediates and mailers that may be provided according to the invention. FIG. 6 illustrates a Z-fold mailer (normal, uniform form, not eccentric) 52. In FIG. 6 components comparable to those in the FIG. 3 embodiment are shown by the same reference numeral only preceded by a "1". FIG. 7 illustrates schematically an intermediate/mailer 54 according to the present invention which is designed to be C-folded. In this embodiment components comparable to those in the FIG. 3 embodiment are shown by the same reference numeral only preceded by a "2".

When an intermediate 10, 52, 54, is folded about its fold lines according to the present invention various panels are formed, which include aligned strips of cohesive which become sealed together. For example with respect to the FIG. 6 embodiment (the FIG. 3 embodiment is essentially the same), a first panel 56 is formed between the transverse edge 119 and fold line 130, a second panel 57 between the fold lines 130, 129, and a third panel 58 between the fold line 129 and the transverse edge 118. The top face 114 (as viewed in FIG. 6) of the first panel 56 is coincident with the bottom face of the second panel 57 on the top face of the third panel 58, while the bottom face (as viewed in FIG. 6) of the first panel 56 is coincident with the top face 115 of the second panel 57 and the bottom face of the third panel 58. The different parts of the cohesive strips 125, 126 come into contact with each other when the panel 56 is Z-folded about the fold line 130 as illustrated in FIG. 6, while the different parts of the cohesive pattern 127, 128, come into contact with each other when the panels 57, 58 are Z-folded with respect to each other as illustrated in FIG. 6. The various transverse patterns (136, 137 and 134, 135) also come into contact with each other. Because the patterns 127, 128 are adjacent the fold lines 121, 122, while the patterns 125, 126 are adjacent the side edges 116, 117—and these strips are spaced from each other (the distance D in the FIG. 4 embodiment) typically about 1–15 mm—there is no problem with blocking when the intermediate/mailer 52 is in a roll configuration (such as the configuration 12 illustrated in FIG. 5).

It will thus be seen that according to the present invention an advantageous intermediate, method of making mailer type business forms, and mailer type business forms, have been provided. While the invention has been herein shown and described in what is presently conceived to be the most practical and preferred embodiment thereof modifications may be made within the scope of the invention. For example other types of score lines, fold lines, or the like may be provided, other strips of adhesive may be provided just to form a reply envelope from different portions of the mailer, windows may be provided where desired, or inserts may be provided (including reply envelopes). Also the sheets which form the mailers may have a wide variety of different dimensions, although approximately 8½×11 inch (e.g. for the FIG. 6 embodiment) or about 10 inches×14 inches (e.g. for the FIG. 1 embodiment), or other standard sizes, may be provided. Thus the invention is to be accorded the broadest interpretation of the appended claims so as to encompass all equivalent structures and methods.

What is claimed is:

1. A mailer type business form intermediate comprising:

a sheet or web of paper having first and second faces, and first and second substantially parallel side edges;

first and second lines of weakness formed in said web or sheet adjacent and substantially parallel to said first and second side edges, respectively to define first and second edge strips, said edge strips each having a width X, in the dimension transverse to said first and second edges;

first and second substantially linear patterns of pressure sensitive cohesive disposed on said first face in said first and second strips, respectively, adjacent said first and second lines of weakness, respectively, and substantially parallel to said first and second lines of weakness, each of said first and second substantially linear patterns having a width Y which is less than X, and substantially no pressure sensitive cohesive in said first face in said first and second strips is adjacent said first and second side edges;

third and fourth substantially linear patterns of pressure sensitive cohesive disposed on said second face in said first and second strips, respectively, adjacent said first and second edges, respectively, and substantially parallel to said first and second edges, and substantially no pressure sensitive cohesive in said second face in said first and second strips is adjacent said first and second lines of weakness;

each of said third and fourth substantially linear patterns having a width Z which is less than X, and wherein Y plus Z is less than X, so that said first and second patterns of cohesive do not overlap, respectively, said third and fourth patterns of adhesive, and so that substantially no cohesive in said first and second strips on said first face overlaps cohesive in said strips on said second face in said transverse direction; and a plurality of fold lines disposed in said web or sheet extending substantially perpendicular to said first and second side edges.

2. A mailer type business form intermediate as recited in claim 1 wherein said web or sheet comprises a web of a plurality of said intermediates in roll configuration with said first and second faces of different portions of said web in contact with each other while said first and second edges of said web are in alignment, said first and second patterns of cohesive not engaging, respectively, said third and fourth patterns of cohesive.

3. A mailer type business form intermediate as recited in claim 1 wherein Y and Z are both less than one-half X, and Y is substantially equal to Z.

4. A mailer type business form intermediate as recited in claim 1 wherein said first and second patterns of cohesive are spaced in said transverse dimension from, respectively, said third and fourth patterns of cohesive, a distance D of at least 5 mm.

5. A mailer type business form intermediate as recited in claim 4 wherein D is about one cm.

6. A mailer type business form intermediate as recited in claim 1 further comprising a plurality of transversely extending substantially linear patterns of pressure sensitive cohesive disposed adjacent and substantially parallel to at least some of said fold lines.

7. A mailer type business form intermediate as recited in claim 6 wherein said plurality of transversely extending patterns of cohesive comprise patterns on both said first and second faces, and wherein said cohesive on said first face is spaced from said cohesive on said second face in said transverse dimension, so that said transversely extending patterns on said first and second faces do not overlap.

8. A mailer type business form intermediate as recited in claim 7 wherein said web or sheet comprises a web of a plurality of said intermediates in roll configuration with said first and second faces of different portions of said web in contact with each other while said first and second edges of said web are in alignment, so that no cohesive on said first face is in contact with cohesive on said second face.

9. A mailer type business form intermediate as recited in claim 8 wherein a plurality of said fold lines comprise lines of weakness separating said plurality of intermediates from each other.

10. A mailer type business form intermediate as recited in claim 2 wherein a plurality of said fold lines comprise lines of weakness separating said plurality of intermediates from each other.

11. A mailer type business form intermediate as recited in claim 10 wherein said intermediates are for Z-fold or eccentric Z-fold intermediates.

12. A mailer type business form intermediate as recited in claim 10 wherein said intermediates are for C-fold or eccentric C-fold intermediates.

13. A mailer type business form intermediate as recited in claim 10 wherein said first and second patterns of cohesive are spaced in said transverse dimension from, respectively, said third and fourth patterns of cohesive, a distance D of at least 5 mm, and wherein Y and Z are substantially equal.

14. A mailer type business form intermediate as recited in claim 13 wherein D is about one cm.

15. A web of a plurality of mailer type business form intermediates comprising:

a web of paper having first and second faces, and first and second substantially parallel side edges;

first and second lines of weakness formed in said web adjacent and substantially parallel to said first and second side edges, respectively to define first and second edge strips, said edge strips each having a width X, in the dimension transverse to said first and second edges;

first and second substantially linear patterns of pressure sensitive cohesive disposed on said first face in said first and second strips, respectively, adjacent said first and second lines of weakness, respectively, and substantially parallel to said first and second lines of weakness, each of said first and second substantially linear patterns having a width Y which is less than X;

third and fourth substantially linear patterns of pressure sensitive cohesive disposed on said second face in said first and second strips, respectively, adjacent said first and second edges, respectively, and substantially parallel to said first and second edges, each of said third and fourth substantially linear patterns having a width Z which is less than X, and wherein Y plus Z is less than X, so that said first and second patterns of cohesive do not overlap, respectively, said third and fourth patterns of adhesive, and so that substantially no cohesive in said first and second strips on said first face overlaps cohesive in said strips on said second face in said transverse direction;

a plurality of fold lines disposed in said web extending substantially perpendicular to said first and second side edges;

wherein said web is in roll configuration defining a plurality of intermediates with said first and second faces of different portions of said web in contact with each other while said first and second edges of said web are in alignment, said first and second patterns of cohesive not engaging, respectively, said third and fourth patterns of cohesive; and a plurality of transversely extending substantially linear patterns of pressure sensitive cohesive disposed adjacent and substantially parallel to at least some of said fold lines.

16. A web as recited in claim 15 wherein said plurality of transversely extending patterns of cohesive comprise patterns on said both first and second faces; and wherein said cohesive on said first face is spaced from said cohesive on said second face in said transverse dimension so that said transversely extending patterns on said first and second faces do not overlap.

* * * * *